United States Patent [19]

Paliotta et al.

[11] Patent Number: 4,848,541

[45] Date of Patent: Jul. 18, 1989

[54] PLURAL PIECE PLASTIC PACKAGE FOR GLASS BOWL AND COVER

[75] Inventors: Michael A. Paliotta, Big Flats; Donald F. Allen, Southport, both of N.Y.

[73] Assignee: F. M. Howell & Co., Elmira, N.Y.

[21] Appl. No.: 258,834

[22] Filed: Oct. 17, 1988

[51] Int. Cl.[4] ..... B65D 73/00

[52] U.S. Cl. ..... 206/45.14; 206/45.33; 206/461

[58] Field of Search ..... 206/45.14, 45.33, 461, 206/467, 484

[56] References Cited

U.S. PATENT DOCUMENTS

| | | | |
|---|---|---|---|
| 4,359,161 | 12/1982 | Sinoff | 206/461 |
| 4,469,226 | 9/1984 | Mainey | 206/461 |
| 4,619,364 | 10/1986 | Czopor, Jr. | 206/461 |
| 4,749,082 | 6/1988 | Gardiner et al. | 206/461 |
| 4,750,669 | 6/1988 | Leight | 206/461 |

*Primary Examiner*—Joseph Man-Fu Moy

*Attorney, Agent, or Firm*—Mason, Fenwick & Lawrence

[57] ABSTRACT

A display package of two-piece fragile cookware comprising a bowl and a lid therefor both formed of glass or ceramic material or the like, including a first preformed plastic sheet shaped to embrace the outer surface of the bowl with the bowl in fully recessed nested relation therein, a second preformed plastic sheet shaped to conform closely to and receive the lid nested therein, and an intervening cushioning sheet coextensively spanning the first and second sheets lying between outer edge portions of the first and second sheets and having integral bulges providing cushioning formations disposed between and separating confronting surfaces of the bowl and lid. The sheets are thermoplastically joined together along their perimeters outwardly of the bowl and lid.

15 Claims, 3 Drawing Sheets

PLURAL PIECE PLASTIC PACKAGE FOR GLASS BOWL AND COVER

BACKGROUND AND OBJECTS OF THE INVENTION

The present invention relates in general to packaging of plural component fragile articles, and more particularly to transparent plastic packaging of plural component fragile cookware articles of glass or ceramic material or the like such as a bowl and cover therefor.

Heretofore, packages have been proposed for plural component cookware assemblies, such as a main container and a lid therefor, formed of glass or ceramic material, together with a snap-on cover which maintains the compartments or interior spaces of the assembly separated, as in Wheaton U.S. Pat. Nos. 3,337,077 and 3,360,153. A two compartment package has also been proposed in the Kerr U.S. Pat. No. 3,454,179 having a lower section and an upper section separated by a divider.

However, such packaging systems have not been designed as top and bottom plastic packaging sections for a container and cover of glass or ceramic or similar material which are preformed by molding to conform to the configuration of the container and cover components and provide a cushioning layer interposed between and separating the container and cover to provide effective protection against breakage and at the same time present an attractive package.

An object of the present invention, therefor, is the provision of a novel three piece transparent plastic assembly for a bowl and lid or cover therefor, both formed of glass, ceramic or similar fragile material, wherein and upper and lower package components respectively cover and form a shaped package section covering respectively the bowl-like main container and lid components, providing recesses for accommodating the confronting faces or confronting portion of the bowl-like container and lid component to be enclosed thereby, and having a plastic transparent separator sheet member having cushioning formations protruding from a generally planiform intermediate sheet to separate the lid and bowl-like container component from each other and protect them against damaging impact with each other.

Another object of the present invention is the provision of a novel package as defined in the preceding paragraph, wherein the top and bottom transparent plastic packaging sections are preformed by molding to provide recesses for accommodating and conforming substantially to the confronting faces or portions of the bowl like container and cover components enclosed thereby.

Another object of the present invention is the provision of a novel packaging system as described in the two immediately preceding paragraphs, wherein the separator sheet is provided with cushioning bar formations distorted from the major plane of the sheet-like intermediate plastic package component forming resiliently deformable cushioning protrusion maintaining a separation between the bowl like container and lid components which is greater than the thickness of the sheet from which the intermediate plastic component is formed.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
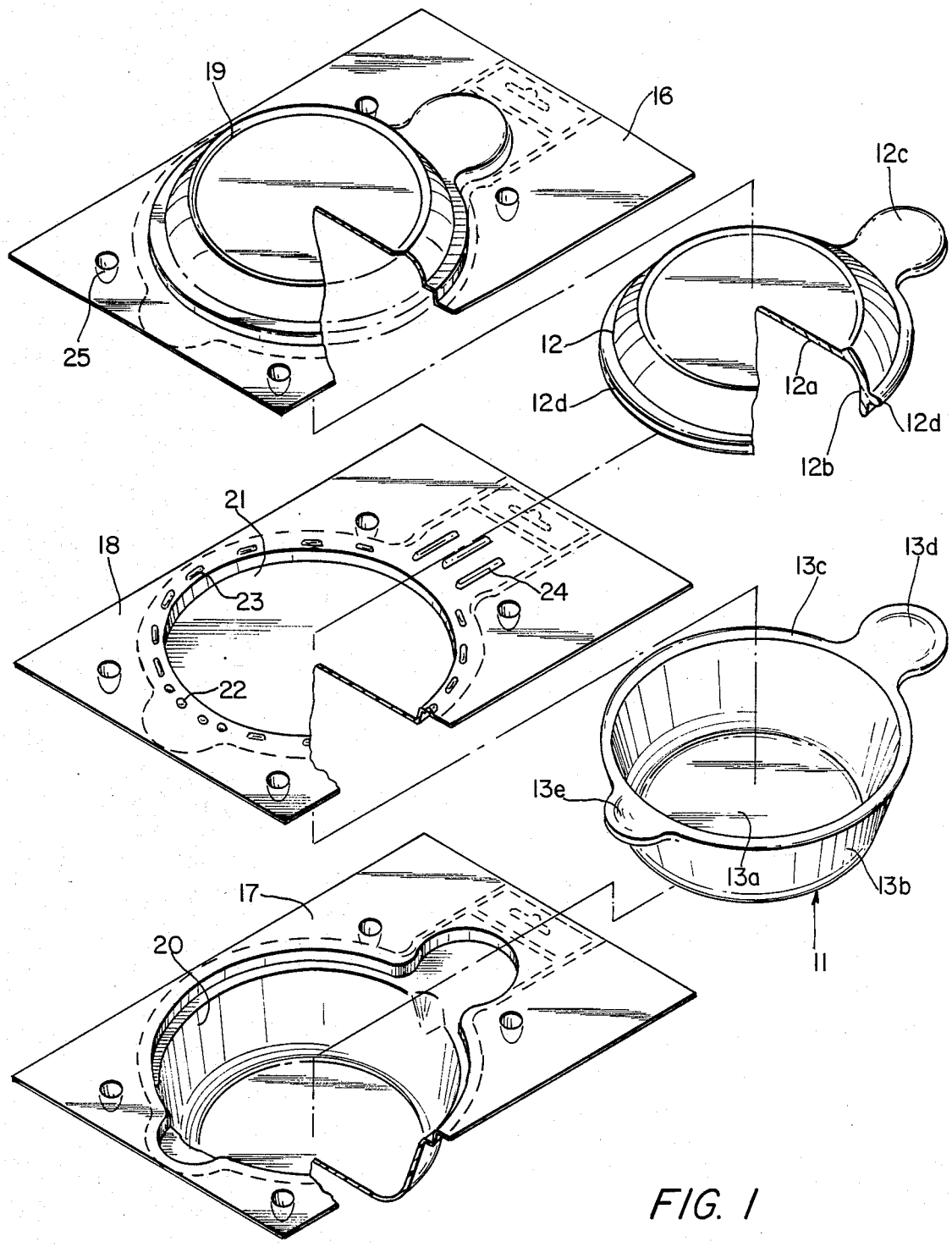
FIG. 1 is an exploded perspective view of a three piece transparent plastic package for a glass bowl and cover therefor, as a preferred embodiment of the present invention, with parts of the plastic sheet components and the lid component broken away to illustrate the configuration thereof in section.
Figure 2:
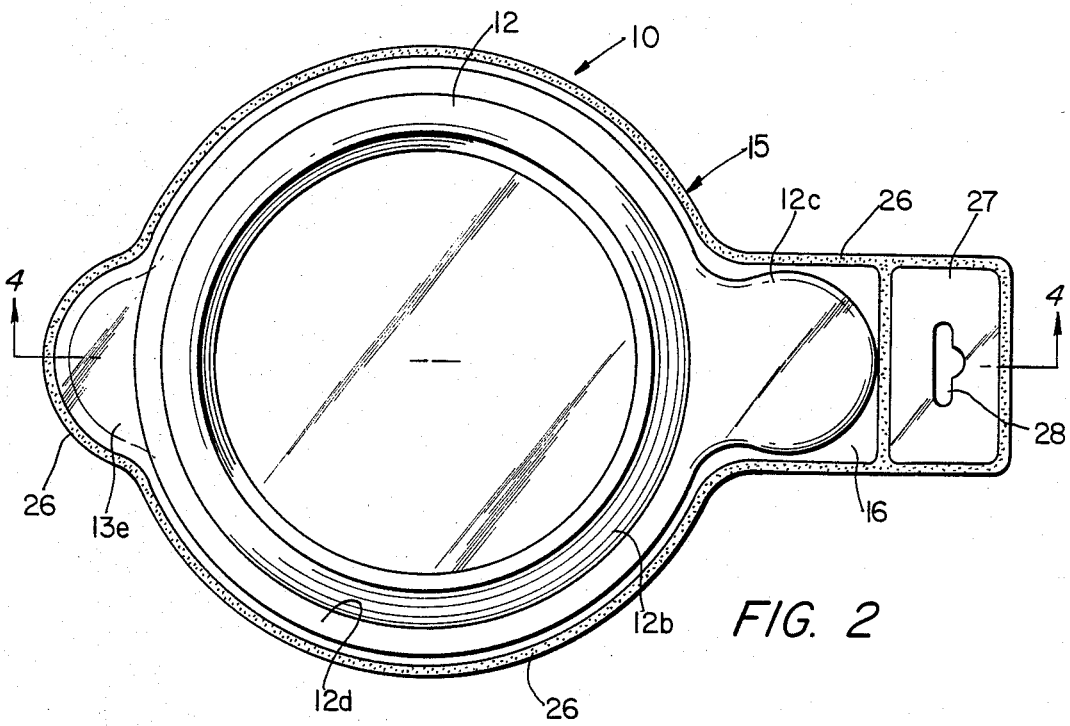
FIG. 2 is a top plan view of the three piece transparent plastic package assembly with the glass bowl and glass lid components packaged therein.
Figure 3:
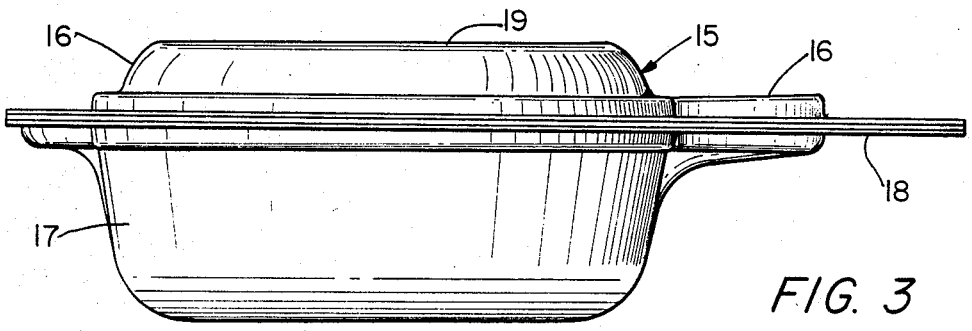
FIG. 3 is a side elevational view thereof viewed from below FIG. 2.
Figure 6:
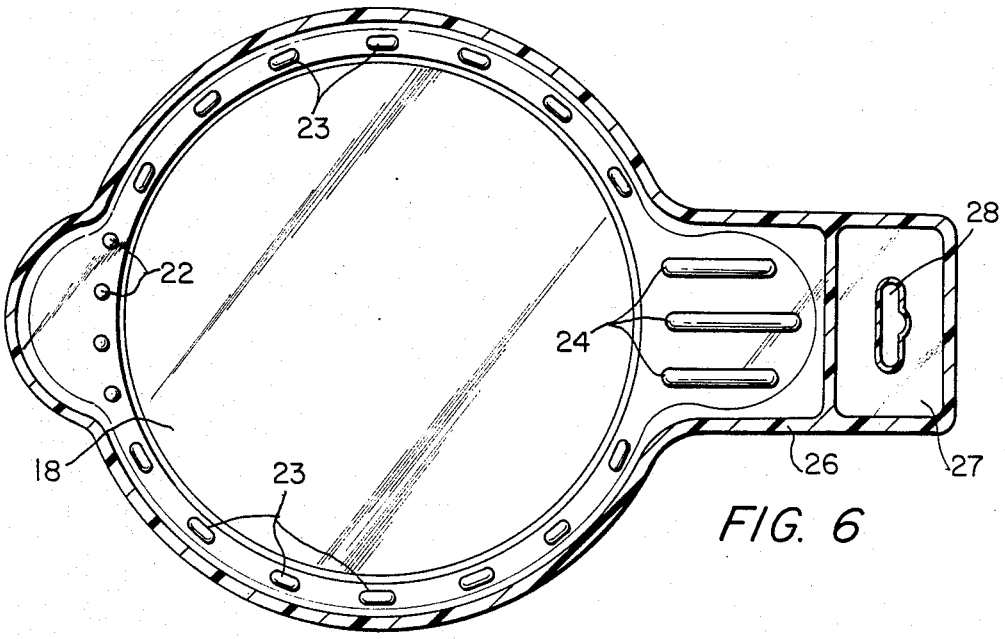
FIG. 6 is a horizontal section view taken along the section plan 6—6 of FIG. 4 located immediately above the intermediate sheet member of the three sheet plastic package assembly.

Referring to the drawings, wherein like reference characters designate corresponding parts throughout the several figures, the three piece plastic sheet component and plural piece cookware package assembly of the present invention is indicated generally by the reference character 10 and is designed to provide a single unitized package for a pair of cookware components, such as a bowl component 11 and a lid component 12, both formed, for example, from glass-ceramic material such as Corning Glass Works glass-ceramic materials for cookware which can be stored in the refrigerator and moved directly to a microwave or cook stove to serve as a cooking vessel. In the illustrated embodiment, the bowl component 11 includes a bowl shaped body portion 13 having a circular bottom **13*a* and upwardly inclined side wall 13*b* terminating in a slightly outwardly protruding peripheral bead and lip 13*c* defining the rim of the bowl. In the illustrated embodiment, the bowl also includes two diametrically opposite outwardly extending handle formations indicated at 13*d* and 13*e*. Similarly, the lid component 12 includes a circular bottom 12*a* and downwardly curving side wall portion 12*b* terminating in a downwardly protruding lip formation 12*c* adapted and sized to protrude a short distance into the uppermost portion of the bowl component 11, and also including and outwardly protruding stop flange formation 12*d* including a handle like extension 12*e* corresponding substantially to the extension 13*d*** of the bowl portion.

The plastic package components, indicated generally by the reference character 15, comprise two outer preformed plastic sheet members 16 and 17 designed to receive the cookware lid component 12 and bowl component 11 respectively therein, together with an inner plastic separator sheet component 18 which has been preformed with contours, as later described, to provide cushioning between the two pieces of glass 11 and 12.

Figure 4:
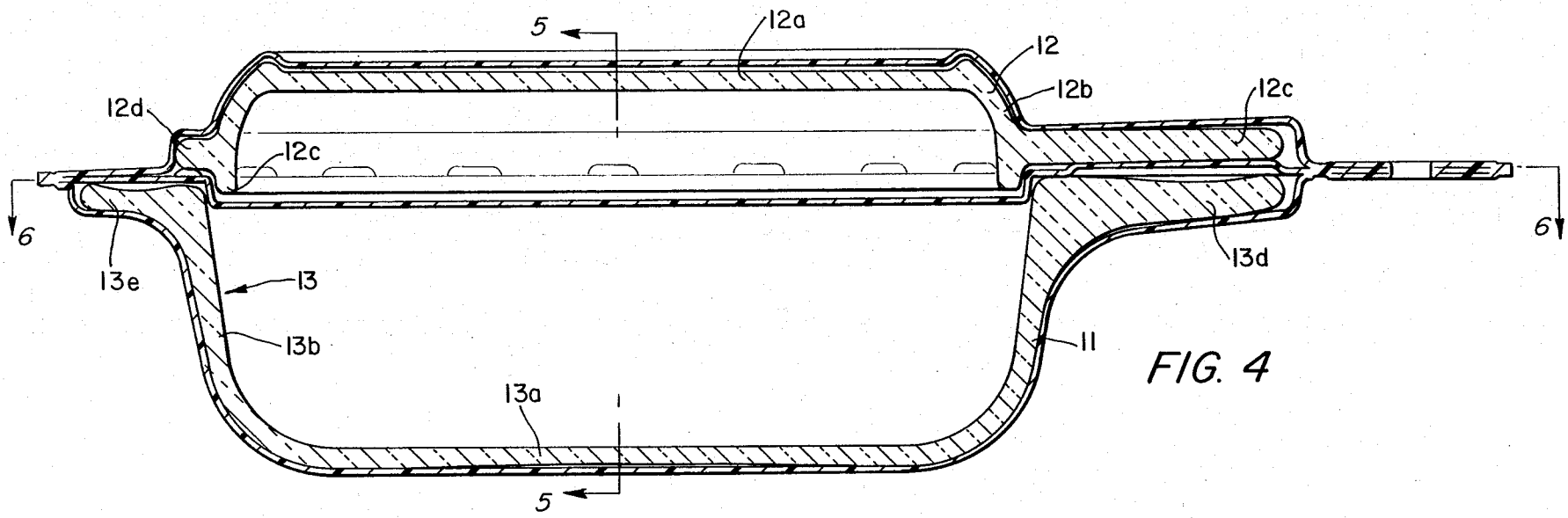
FIG. 4 is a vertical longitudinal section thereof taken from the line 4—4 of FIG. 2.
Figure 5:
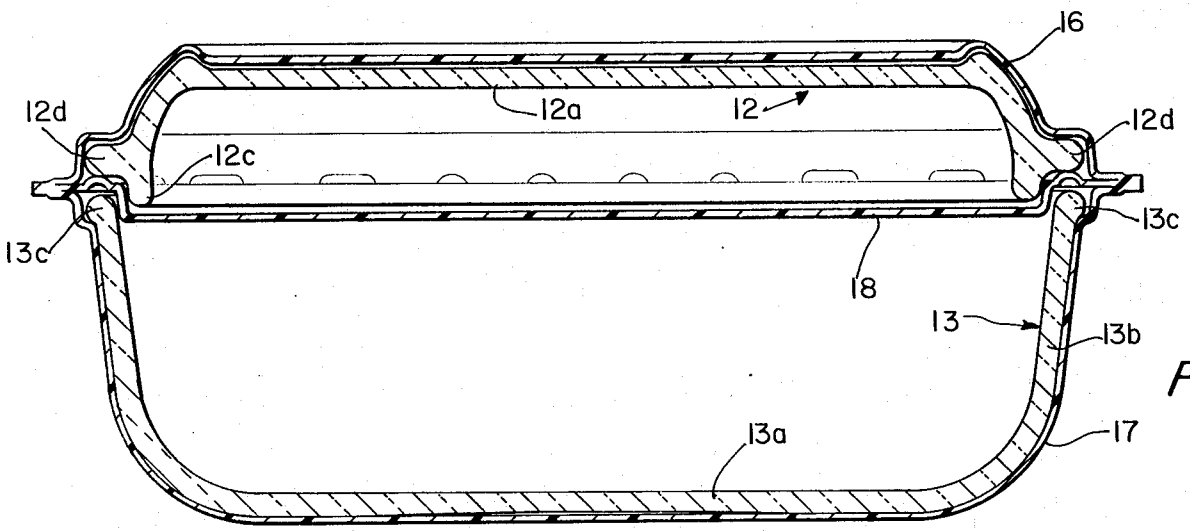
FIG. 5 is a vertical transverse sectional view thereof taken along the line 5—5 of FIG. 4.

More specifically, the upper preformed transparent plastic sheet component 16 includes an upwardly protruding cavity or dome formation 19 shaped to correspond to the confronting surface contours of the circular top and sides 12*a* and 12*b* of the cookware lid 12 as well as the flange formation 12*d* and handle formation 12*e* thereof, so that the lid is recessed in encapsulated relation therein as illustrated in FIGS. 4 and 5. Similarly, the lower transparent plastic sheet component 17 is provided with a preformed cavity or well formation 20 therein corresponding to the confronting surface contours of the bottom 13*a*, sides 13*b*, lip 13*c* and handle formation 13*d* and 13*e* of the bowl cookware component 11 receiving the bowl component in nested recessed relation therein as shown in FIGS. 4 and 5.

The intermediate separator piece of transparent plastic sheet material 18 has a circular downwardly offset shallow well formation 21 preformed therein sized to extend slightly into the uppermost portion of the bowl 11 and to receive and encircle the downwardly extending lip formation 12*c* of the lid component 12. Encircling the side wall of this shallow well formation 21 are a plurality of circular bulges 22 and circumferentially elongated bar-shaped bulges 23, protruding upwardly, for example about 0.06 inch above the plane of the upper face of the sheet component 18, together with a plurality, of elongated, side-by-side parallel bar shaped bulges 24, for example 3 as illustrated in the drawings, disposed within the area lying between the handle formation 12*e* of the lid component 12 and the handle formation 13*d* of the bowl component 11. These contoured bulge formations 22, 23 and 24 in the intermediate or middle plastic sheet component 18 provide cushioning between the two pieces of glass, that is, the lid 12 and the bowl 11 to prevent any glass-to-glass contact which might cause product damage. This assembly, with the three plastic sheet 16, 17 and 18 and the two glass or glass-ceramic cookware components 12 and 11 are superposed in an assembly as shown in FIGS. 2–6 and the three plastic components 17, 18 and 19 are perimeter-sealed, as by sealing them, creating a single unitized package wherein package integrity is ensured by locking the separating piece in place, encapsulating both glass components, and providing cushioning between the two pieces of glass as well as preventing any glass-to-glass contact.

The plastic sheet component 17, 18 and 19 may be provided as preformed rectangular sheet components as illustrated in FIG. 1 prior to assembly, and may be provided with locator pin dimple formations, indicated by reference character 25, in the form of downwardly projecting substantially conically bulges in the sheet material spaced outwardly from the perimeter of the glass lid and bowl receiving portions, positioned so that the dimple formations 25 and sheet 18 interfit in similar dimple formations of sheet 17 and the dimple formations 25 of sheet 16 interfit in those of middle sheet 18, to provide proper registration of the preformed components. The overlying plastic sheet components with the glass lid and bowl components 12 and 11 properly positioned therein may then be perimeter sealed by thermoplastic sealing immediately inwardly of the dotted line paths shown in FIG. 1, corresponding to the thermoplastic sealed perimeter regions indicated by the reference character 26 in FIG. 2, and the plastic sheets cut immediately outwardly of this perimeter sealed pattern to provide the finished package product. As illustrated, a hanger extension portion 27 may be providing having a hanger opening 28 therein to facilitate hanging the product on a conventional display hook for convenient storage or display of the package assembly on a sales floor.

We claim:

1. A display package of a plural piece fragile cookware article comprising a bowl and a lid therefor both formed of glass or ceramic material or the like and each having a confronting bounding edge, comprising a three-sheet plastic package assembly; the package assembly including a first preformed plastic sheet component shaped to form a convexly bowed portion conforming closely to the configuration of the outer surface of said bowl receiving the latter in fully recessed nested relation therein and a rim portion outwardly encircling the bowed portion lying in a plane flush with the bounding edge of said bowl, a second preformed plastic sheet component having a convexly bowed portion shaped to conform closely to the exterior surface of said lid to receive the latter nested therein and having a rim portion outwardly encircling its associated bowed portion and lying a plane parallel and adjacent the plane of the rim portion of the first sheet component, and an intervening cushioning sheet component coextensively spanning the first and second sheet components lying in a plane between and adjacent the planes of the lip portion of said first and second sheet components and having integral bulges providing cushioning formations disposed between and separating the confronting bounding edges of said bowl and lid; said sheet components being thermoplastically joined together along their rim portions with their rim portions and the periphery of said intervening sheet being in coextensive registry with each other.

2. A display package as defined in claim 1, wherein said three plastic sheet components are transparent plastic sheet material.

3. A display package as defined in claim 1, wherein said intervening cushioning sheet component has a rim conforming to and registering with said rim portions with said first and second plastic sheet components and said rim portions extend in a substantially circular path around the adjacent edge portions of said bowl and lid and are sealed together to form a unitary package of sheet components integrally joined together about the package perimeter.

4. A display package as defined in claim 2, wherein said intervening cushioning sheet component has a rim conforming to and registering with said rim portions with said first and second plastic sheet components and said rim portions extend in a substantially circular path around the adjacent edge portions of said bowl and lid and are sealed together to form a unitary package of sheet components integrally joined together about the package perimeter.

5. A display package as defined in claim 1, wherein said bulges of said intervening cushioning sheet component include circumferentially elongated bar formations arranged as a spaced series of bars disposed in a circular path outwardly encircling said uppermost edge portion of said bowl.

6. A display package as defined in claim 2, wherein said bulges of said intervening cushioning sheet component include circumferentially elongated boar formations arranged as a spaced series of bars disposed in a circular path outwardly encircling said uppermost edge portion of said bowl.

7. A display package as defined in claim 3, wherein said bulges of said intervening cushioning sheet component include circumferentially elongated bar formations arranged as a spaced series of bars deformed in the rim of said intervening sheet component disposed in a circular path outwardly encircling said uppermost edge portion of said bowl.

8. A display package as defined in claim 4, wherein said bulges of said intervening cushioning sheet component include circumferentially elongated bar formations arranged as a spaced series of bars deformed in the rim of said intervening sheet component disposed in a circular path outwardly encircling said uppermost edge portion of said bowl.

9. A display package as defined in claim 1, wherein said bowl includes a pair of diametrically opposite handle formations protruding outwardly form said uppermost edge portion and lying substantially in said plane at said edge portion, said lid having at least one handle formation conforming substantially to a handle formation of the bowl and positioned in overlying registry therewith, and said intervening cushioning sheet component having plural parallel elongated bar-like cushioning bulge formations preformed therein at an interposing position between registering handle formations of said bowl and lid to maintain a predetermined separation therebetween, the three sheet components being thermoplastically united together outwardly about said handle formations.

10. A display package as defined in claim 2, wherein said bowl includes a pair of diametrically opposite handle formations protruding outwardly form said uppermost edge portion and lying substantially in said plane at said edge portion, said lid having at least one handle formation conforming substantially to a handle formation of the bowl and positioned in overlying registry therewith, and said intervening cushioning sheet component having plural parallel elongated bar-like cushioning bulge formations preformed therein at an interposing position between registering handle formations of said bowl and lid to maintain a predetermined separation therebetween, the three sheet components being thermoplastically united together outwardly about said handle formations.

11. A display package as defined in claim 3, wherein said bowl includes a pair of diametrically opposite handle formations protruding outwardly form said uppermost edge portion and lying substantially in said plane at said edge portion, said lid having at least one handle formation conforming substantially to a handle formation of the bowl and positioned in overlying registry therewith, and said intervening cushioning sheet component having plural parallel elongated bar-like cushioning bulge formations preformed therein at an interposing position between registering handle formations of said bowl and lid to maintain a predetermined separation therebetween, the three sheet components being thermoplastically united together outwardly about said handle formations.

12. A display package as defined in claim 4, wherein said bowl includes a pair of diametrically opposite handle formations protruding outwardly form said uppermost edge portion and lying substantially in said plane at said edge portion, said lid having at least one handle formation conforming substantially to a handle formation of the bowl and positioned in overlying registry therewith, and said intervening cushioning sheet component having plural parallel elongated bar-like cushioning bulge formations preformed therein at an interposing position between registering handle formations of said bowl and lid to maintain a predetermined separation therebetween, the three sheet components being thermoplastically united together outwardly about said handle formations.

13. A display package as defined in claim 5, wherein said bowl includes a pair of diametrically opposite handle formations protruding outwardly form said uppermost edge portion and lying substantially in said plane at said edge portion, said lid having at least one handle formation conforming substantially to a handle formation of the bowl and positioned in overlying registry therewith, and said intervening cushioning sheet component having plural parallel elongated bar-like cushioning bulge formations preformed therein at an interposing position between registering handle formations of said bowl and lid to maintain a predetermined separation therebetween, the three sheet components being thermoplastically united together outwardly about said handle formations.

14. A display package as defined in claim 6, wherein said bowl includes a pair of diametrically opposite handle formations protruding outwardly form said uppermost edge portion and lying substantially in said plane at said edge portion, said lid having at least one handle formation conforming substantially to a handle formation of the bowl and positioned in overlying registry therewith, and said intervening cushioning sheet component having plural parallel elongated bar-like cushioning bulge formations preformed therein at an interposing position between registering handle formations of said bowl and lid to maintain a predetermined separation therebetween, the three sheet components being thermoplastically united together outwardly about said handle formations.

15. A display package as defined in claim 8, wherein said bowl includes a pair of diametrically opposite handle formations protruding outwardly form said uppermost edge portion and lying substantially in said plane at said edge portion, said lid having at least one handle formation conforming substantially to a handle formation of the bowl and positioned in overlying registry therewith, and said intervening cushioning sheet component having plural parallel elongated bar-like cushioning bulge formations preformed therein at an interposing position between registering handle formations of said bowl and lid to maintain a predetermined separation therebetween, the three sheet components being thermoplastically united together outwardly about said handle formations.

* * * * *